US011267492B2

(12) United States Patent
Wood et al.

(10) Patent No.: US 11,267,492 B2
(45) Date of Patent: Mar. 8, 2022

(54) RUBBER SUSPENSION UNIT OF A DIAPHRAGM ASSEMBLY FOR PASSAGE BETWEEN RAIL CARS

(71) Applicant: HUBNER Manufacturing Corp, Mt. Pleasant, SC (US)

(72) Inventors: Barbara Jo Wood, Mt. Pleasant, SC (US); Thomas Merrill Turko, Mt. Pleasant, SC (US); Jacob Adam Reece, Mt. Pleasant, SC (US)

(73) Assignee: HUBNER Manufacturing Corp, Mt. Pleasant, SC (US)

( * ) Notice: Subject to any disclaimer, the term of this patent is extended or adjusted under 35 U.S.C. 154(b) by 280 days.

(21) Appl. No.: 16/441,666

(22) Filed: Jun. 14, 2019

(65) Prior Publication Data

US 2020/0391771 A1 Dec. 17, 2020

(51) Int. Cl.
*B61D 17/22* (2006.01)
*B61D 17/20* (2006.01)

(52) U.S. Cl.
CPC ..... *B61D 17/22* (2013.01); *B61D 17/20* (2013.01)

(58) Field of Classification Search
CPC ..... B61D 17/22; B61D 17/00; B61D 17/02; B61D 17/20; B61D 17/06; B61D 17/18; B61D 49/00
See application file for complete search history.

(56) References Cited

U.S. PATENT DOCUMENTS

| | | | | |
|---|---|---|---|---|
| 2,090,492 A * | 8/1937 | Udstad | B61D 17/20 105/15 |
| 2,131,493 A * | 9/1938 | Thompson | B61D 17/20 105/15 |
| 2,568,684 A * | 9/1951 | Mihalyi | A63H 19/16 105/18 |
| 2,907,281 A * | 10/1959 | Moulton | B61D 17/20 105/10 |
| 4,599,947 A * | 7/1986 | Keefer | B61D 17/22 105/15 |
| 4,765,249 A * | 8/1988 | Ishizuka | B61D 17/22 105/10 |
| 8,201,503 B2 * | 6/2012 | Huppert | B61D 17/22 105/15 |
| 2018/0056741 A1 * | 3/2018 | Krug | B60D 5/00 |

* cited by examiner

*Primary Examiner* — Zachary L Kuhfuss
*Assistant Examiner* — Cheng Lin
(74) *Attorney, Agent, or Firm* — Dinsmore & Shohl LLP

(57) ABSTRACT

A railcar diaphragm includes a car side assembly configured to be coupled to an end wall of a railcar, a wear side assembly configured to engage the wear side assembly of another railcar diaphragm or an other railcar when the other railcar is coupled to the railcar, a bellows assembly disposed between the car side assembly and the wear side assembly to provide a pathway and at least one elastomer suspension unit assembly including an elastomer suspension unit, a bearing assembly and an arm having a first end coupled to the elastomer suspension unit and a second end coupled to the bearing assembly. The elastomer suspension unit assembly is coupled to the car side or wear side assembly via the bearing assembly. The arm is biased towards an initial position by the elastomer suspension unit as a distance between the car side assembly and the wear side assembly changes.

13 Claims, 11 Drawing Sheets

RUBBER SUSPENSION UNIT OF A DIAPHRAGM ASSEMBLY FOR PASSAGE BETWEEN RAIL CARS

FIELD OF THE INVENTION

This invention relates to railcar diaphragms and, in particular, relates to elastomer suspension unit assemblies used for the railcar diaphragms.

BACKGROUND OF THE INVENTION

Diaphragms are structures attached to the ends of adjacent railroad cars (or railcars) to provide an enclosed space between the adjacent railcars that permits passengers and/or workers to move from one railcar to the other. Diaphragms provide passengers a means to transition from one rail car to the next while mitigating potential opening. Diaphragms also provide limited protection from the environment, and noise when the passengers move between railcars. Moreover, diaphragms are constructed such that they can absorb forces produced by the moving train when, for example, the train is navigating a curve at a relatively high speed.

SUMMARY OF THE INVENTION

The present invention provides railcar diaphragms with integrated elastomer suspension units. By using the elastomer suspension unit to provide smooth, non-mechanical movement and to introduce dampening into the system, the diaphragm in accordance with the present invention provides great compression capability of the diaphragm and aids in preserving the life of bellows fabric. Using multiple elastomer suspension units in a diaphragm provides a capability of independent movements. The diaphragms in accordance with the present invention may have reduced weight and may be easier to maintain.

According to an embodiment of the present invention, a railcar diaphragm a car side assembly configured to be coupled to an end wall of a railcar, a wear side assembly configured to engage the wear side assembly of another railcar diaphragm or an other railcar the other railcar is coupled to the railcar, a bellows assembly disposed between the car side assembly and the wear side assembly to provide a pathway, and at least one elastomer suspension unit assembly including an elastomer suspension unit and an arm.

In one embodiment, the at least one elastomer suspension unit assembly includes one elastomer suspension unit assembly. The elastomer suspension unit assembly includes an elastomer suspension unit, a bearing assembly and an arm. The arm is coupled to the elastomer suspension unit at a first end and coupled to the bearing assembly at a second end. The at least one elastomer suspension unit assembly may be coupled to one of the car side and wear side assembly via the bearing assembly. The bearing assembly may be comprised of a pin, bushings, a mounting plate and fasteners, etc.

The initial position corresponds to an extended state of the diaphragm when the elastomer suspension unit assembly is not coupled to train railcars. The bellows is in a neutral position neither stretched nor compressed at this time. There is no biased load on the rubber inserts at this time.

When coupled to train cars, the diaphragm includes two states, i.e., a nominal state and a compressed state. In the nominal state, the elastomer suspension unit is biased and the bellows is compressed compared to the extended state.

In the compressed state, the elastomer suspension unit is biased and the bellows is further compressed compared to the nominal state. The elastomer suspension unit is constantly in work or biased towards the initial position when coupled to train cars. The biased load changes as a distance between the car side assembly and the wear side assembly changes.

In one embodiment, the elastomer suspension unit is mounted to the other of the car side assembly and the wear side assembly such that the elastomer suspension unit assembly is coupled to the other of the car side and wear side assembly via the elastomer suspension unit.

The elastomer suspension unit and the bearing assembly may be mounted relative to each other such that the arm is at an angle relative to the car side assembly and the wear side assembly, when the diaphragm is in the nominal state.

In one embodiment, the elastomer suspension unit assembly further comprises a second arm and a second bearing assembly. The second arm may be coupled to the elastomer suspension unit at a first end and coupled to the second bearing assembly at a second end. The second bearing assembly is mounted to the same side as the first bearing assembly is such that the first arm and the second arm mirror each other. The suspension unit is mounted to the other of the car side and wear side assembly.

In another embodiment, instead of comprising a second bearing assembly, the elastomer suspension unit assembly further comprises a second arm and a second elastomer suspension unit, where a first end of the second arm is coupled to the second elastomer suspension unit and a second end of the second arm is coupled to the bearing assembly.

In another embodiment, the elastomer suspension unit assembly may comprise a second arm and a second bearing assembly. The second arm may be coupled to the elastomer suspension unit at a first end and coupled to the second bearing assembly at a second end. The second arm is mounted to the other of the car side and wear side assembly. In this embodiment, the elastomer suspension unit is not mounted to either the car side or wear side assembly. The first arm and second arm are connected and biased by the elastomer suspension unit.

In another embodiment, the elastomer suspension unit assembly further comprises a third arm, a fourth arm and a second elastomer suspension unit. A second end of the third arm and fourth arm are coupled to the second elastomer suspension unit respectively. A first end of the third arm is coupled to the bearing assembly. A first end of the fourth arm is coupled to the second bearing assembly such that the at least one elastomer suspension unit assembly has a shape of a parallelogram.

In one embodiment, the at least one elastomer suspension unit assembly includes four elastomer suspension unit assemblies. Two of the four elastomer suspension unit assemblies are mounted to the top of the car side assembly and the wear side assembly and mirror each other. The other two of the four elastomer suspension unit assemblies are mounted to the bottom of the car side assembly and the wear side assembly and mirror each other. The elastomer suspension unit of each of the four elastomer suspension unit assemblies may be mounted to a central region of the top or bottom of the car side assembly and the wear side assembly or may be mounted to the sides of the top or bottom of the car side assembly and the wear side assembly or a combination of both.

In this embodiment, the elastomer suspension unit of each of the four elastomer suspension unit assemblies may be mounted to a central region of the top or bottom of the car side assembly and the wear side assembly.

In another version of this embodiment, the elastomer suspension units of two of the four elastomer suspension unit assemblies at the top or bottom are mounted to a central region of the top or bottom of the car side assembly and the wear side assembly and the elastomer suspension units of the other two of the four elastomer suspension unit assemblies at the bottom or top are mounted to the sides of the top or bottom of the car side assembly and the wear side assembly.

In one embodiment, the at least one elastomer suspension unit assembly includes two elastomer suspension unit assemblies. The two elastomer suspension unit assemblies are mounted to the car side assembly and the wear side assembly such that two elastomer suspension unit assemblies mirroring each other.

In another embodiment, the elastomer suspension unit assembly includes two elastomer suspension unit assemblies adjacent to each other.

In some embodiments, the second end of the arm slides and pivots relative to the bearing assembly when the distance between the car side assembly and the wear side assembly changes. In another embodiment, the second end of the arm pivots about the bearing assembly and does not slide relative to the bearing assembly.

The elastomer suspension unit assembly may be mounted at the top, bottom or sides of the car side assembly or the wear side assembly of the railcar diaphragm.

In some embodiments, the railcar diaphragm may further comprise a rubber support assembly. The rubber support assembly may be mounted at the bottom of the railcar diaphragm.

The railcar diaphragm may further comprise a plurality of rubber stoppers mounted on the sides of the car side assembly or the wear side assembly.

In another embodiment, an elastomer suspension unit assembly may be used as train mounts to connect onto a train railcar body. The elastomer suspension unit assembly may comprise elastomer suspension units mounted to the wear side at the bottom of the wear side and bearing assemblies connected to the elastomer suspension units to be connected directly to the train body as opposed to the car side of the diaphragm. The bottom part of the car side of the diaphragm may be open to allow for the train mounts to pass through.

In addition to the specific embodiments above-discussed, elements and aspects of one embodiment may be combined with elements and aspects of another embodiment without departing from the scope or teaching of the present invention.

DETAILED DESCRIPTION OF THE DRAWINGS

Figure 1:
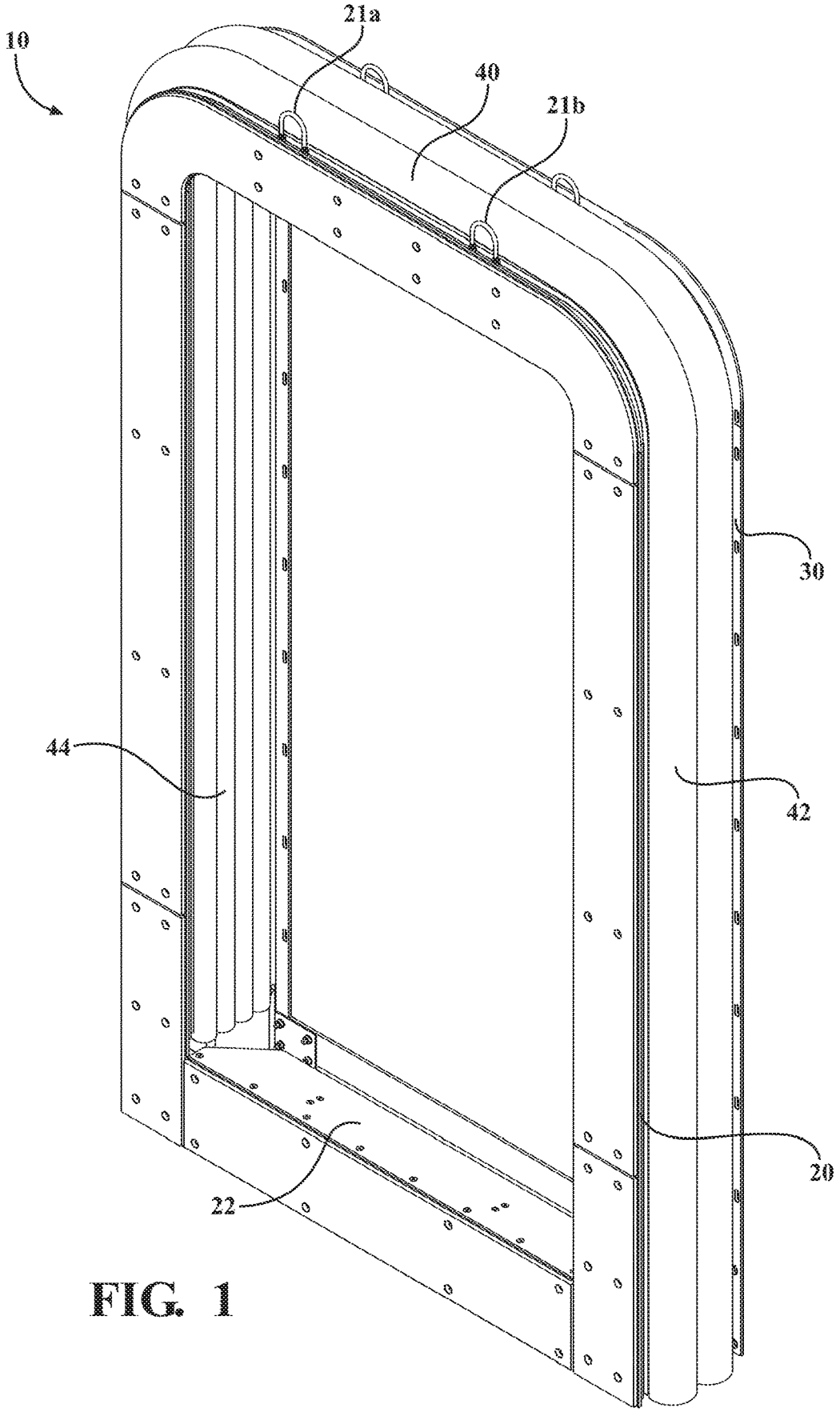
FIG. 1 is a perspective view of a diaphragm with bellows in accordance with an embodiment of the present invention.
Figure 2:
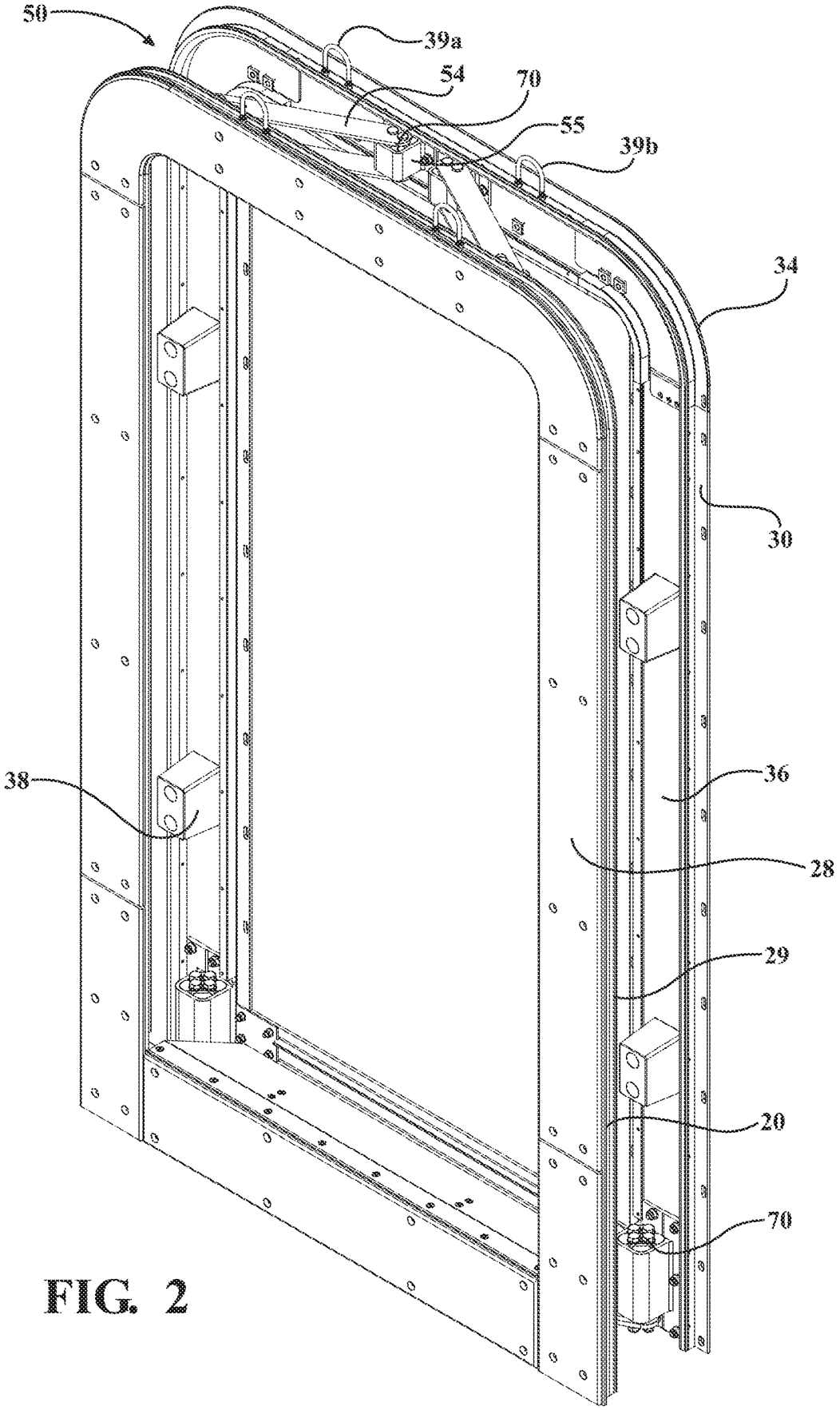
FIG. 2 is a perspective view of the diaphragm of FIG. 1 without the bellows.

FIG. 1 is a perspective view of a diaphragm with bellows according to an embodiment of the present invention. FIG. 2 is a similar view with the bellows removed to show details. The diaphragm is configured to be fixed to a railcar, an adapter of a railcar, a gangway, another diaphragm of the same type or different type, or other portions of the end wall of a railcar such that the diaphragm 10 and another adjacent railcar, diaphragm or gangway can provide an enclosed space between the adjacent railcars that permits passengers to conveniently move from one railcar to the other while being protected from environmental and/or noise conditions. The diaphragm can also be attached to the end of a caboose.

The diaphragm 10 includes a wear side assembly 20, and a car side assembly 30, a bellows assembly 40 and an elastomer suspension unit assembly 50. The wear side assembly 20 abuts the adjacent car or diaphragm thereof when the railcars are engaged or coupled. The wear side assembly 20 can include one or multiple lifting rings, such as the lifting rings 21*a* and 21*b*, that can be used to lift and attach the diaphragm 10 to the end wall of a railcar or to remove the diaphragm 10 from the end wall of the railcar for replacement or repair. Lifting of the diaphragm can be by u-bolts, eye bolts, hooks or the like. The wear side assembly 20 may include a walk plate 22 for passengers to walk over when moving between railcars.

Figure 5:
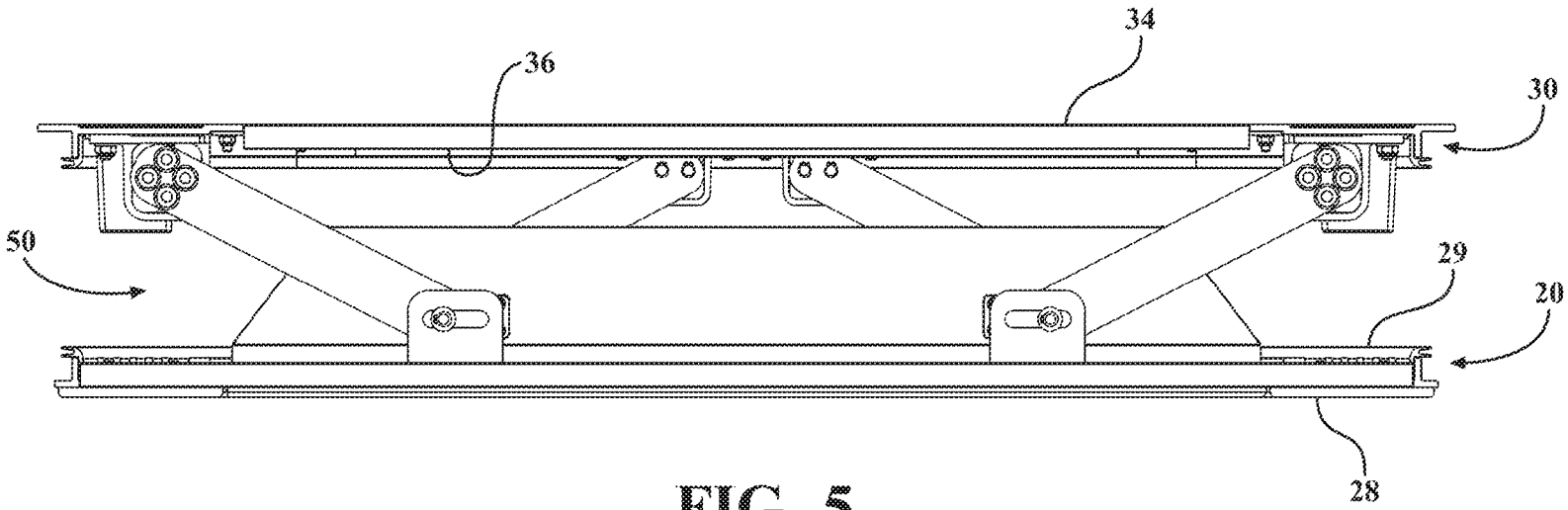
FIG. 5 is an end view of the diaphragm of FIG. 1 without the bellows.
Figure 6:
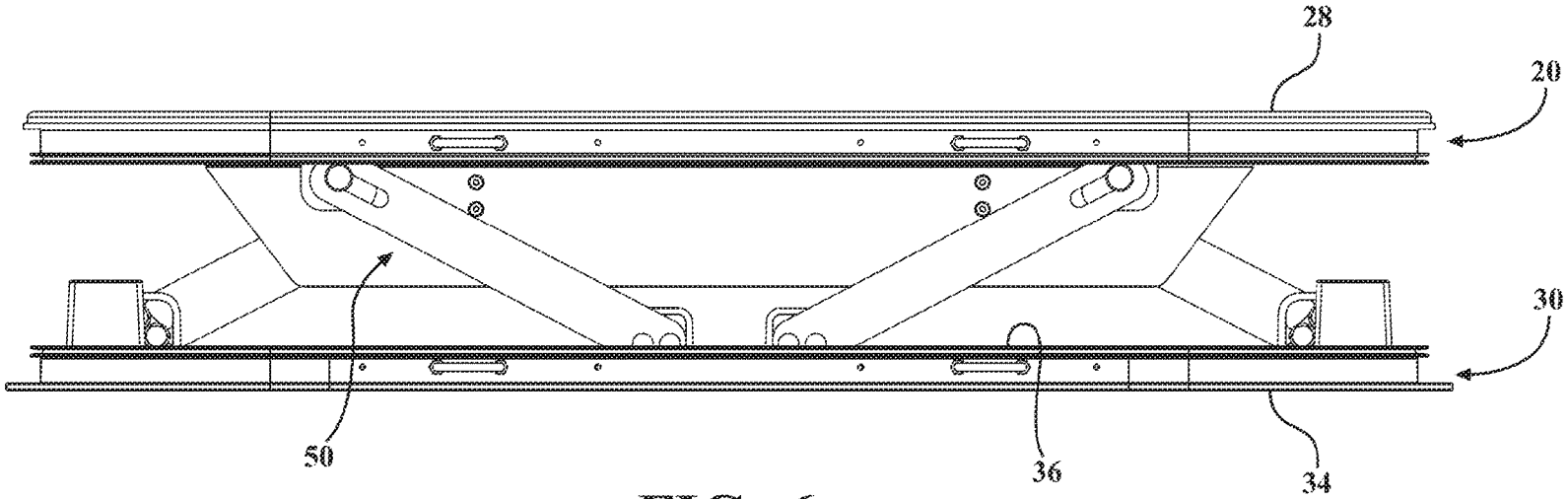
FIG. 6 is a top view of the diaphragm of FIG. 1 without the bellows.

Referring to FIGS. 2, 5 and 6, the wear side assembly includes a wear plate side 28 and an inner mounting side 29. The wear plate side 28 of the wear side assembly 20 abuts the adjacent car or diaphragm when the railcars are engaged or coupled. The elastomer suspension unit assembly 50 is mounted to the inner mounting side 29 of the wear side assembly 20. The wear side assembly 20 is coupled to the car side assembly 30 by the elastomer suspension unit assembly 50.

Figure 4:
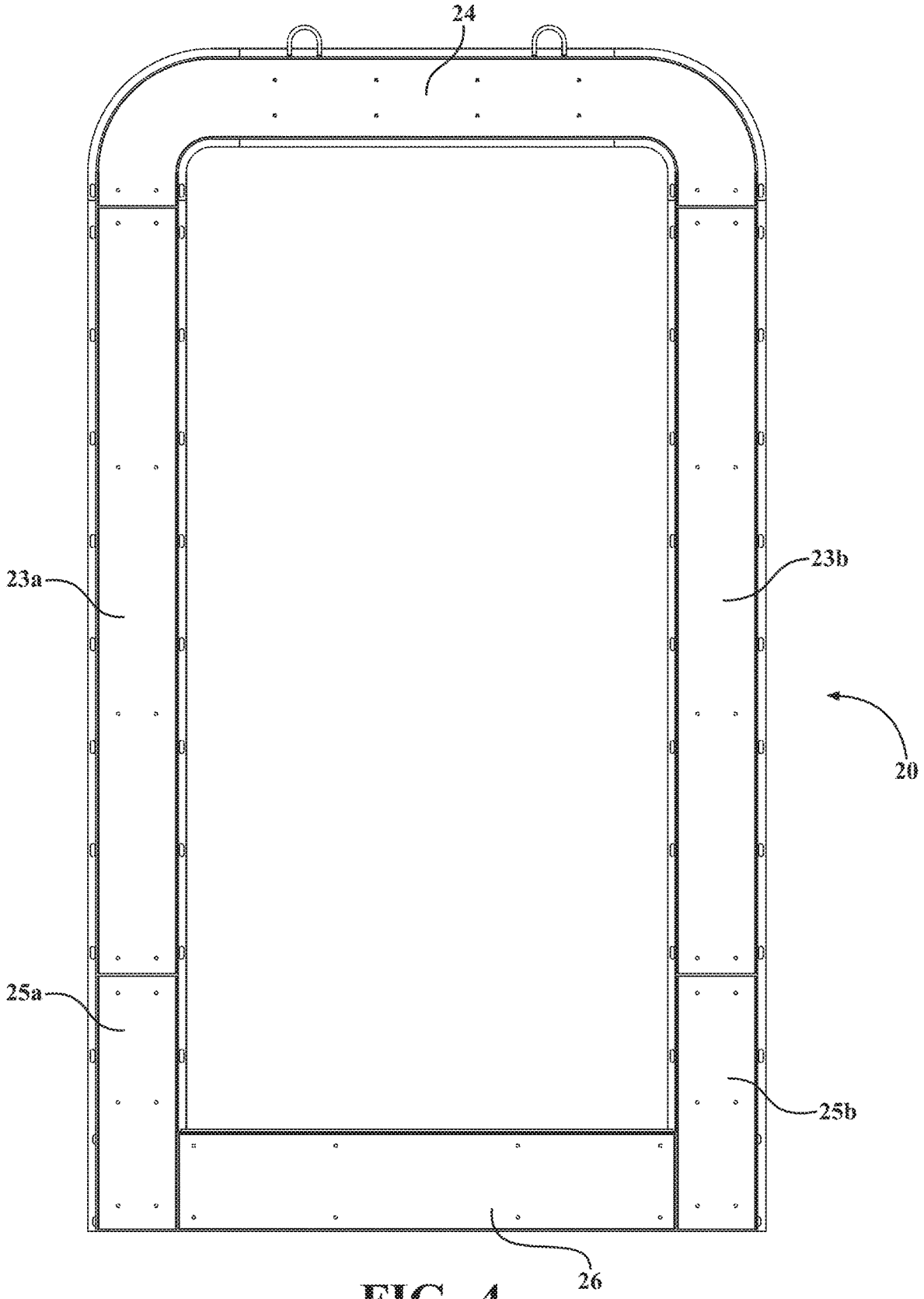
FIG. 4 is a front view of a wear side assembly of the diaphragm in FIG. 1.

In an embodiment shown in FIG. 4, the wear plate side 28 includes a top horizontal segment 24 with round corners, a bottom horizontal straight segment 26, two upper vertical side straight segment 23*a*, 23*b* and two lower vertical side straight segments 25*a*, 25*b*. The two lower vertical side straight segments 25*a*, 25*b* are connected to the lower horizontal segment 26. Wear plates are detachably connected to the extrusions and the castings and are configured to be easily removed or replaced. When the wear plates are damaged or wear out as a result of wear and tear of the diaphragm, the worn out segment can be removed and replaced with a new segment. In other embodiments, the wear plate side 28 can include fewer or more segments than shown in FIG. 4. The wear plates can be made from polystone, thermoplastic, durostone, phenolic, nylon or nylon composites.

The car side assembly 30 is used to couple or interface the diaphragm 10 to the end wall of a rail car. In some embodiments, the diaphragm 10 can be coupled to the end wall of a railcar by attaching the car side assembly 30 to any structurally-rigid portions of the end wall.

Still referring to FIGS. 2, 5 and 6, the car side assembly 30 includes a car mounting side 34, an elastomer suspension unit mounting side 36. The car mounting side 34 of the car side assembly 30 is mounted to the end wall of a railcar or attached frame. The elastomer suspension unit assembly 50 may be mounted to the inner elastomer suspension unit mounting side 36 of the car side assembly.

Figure 3:
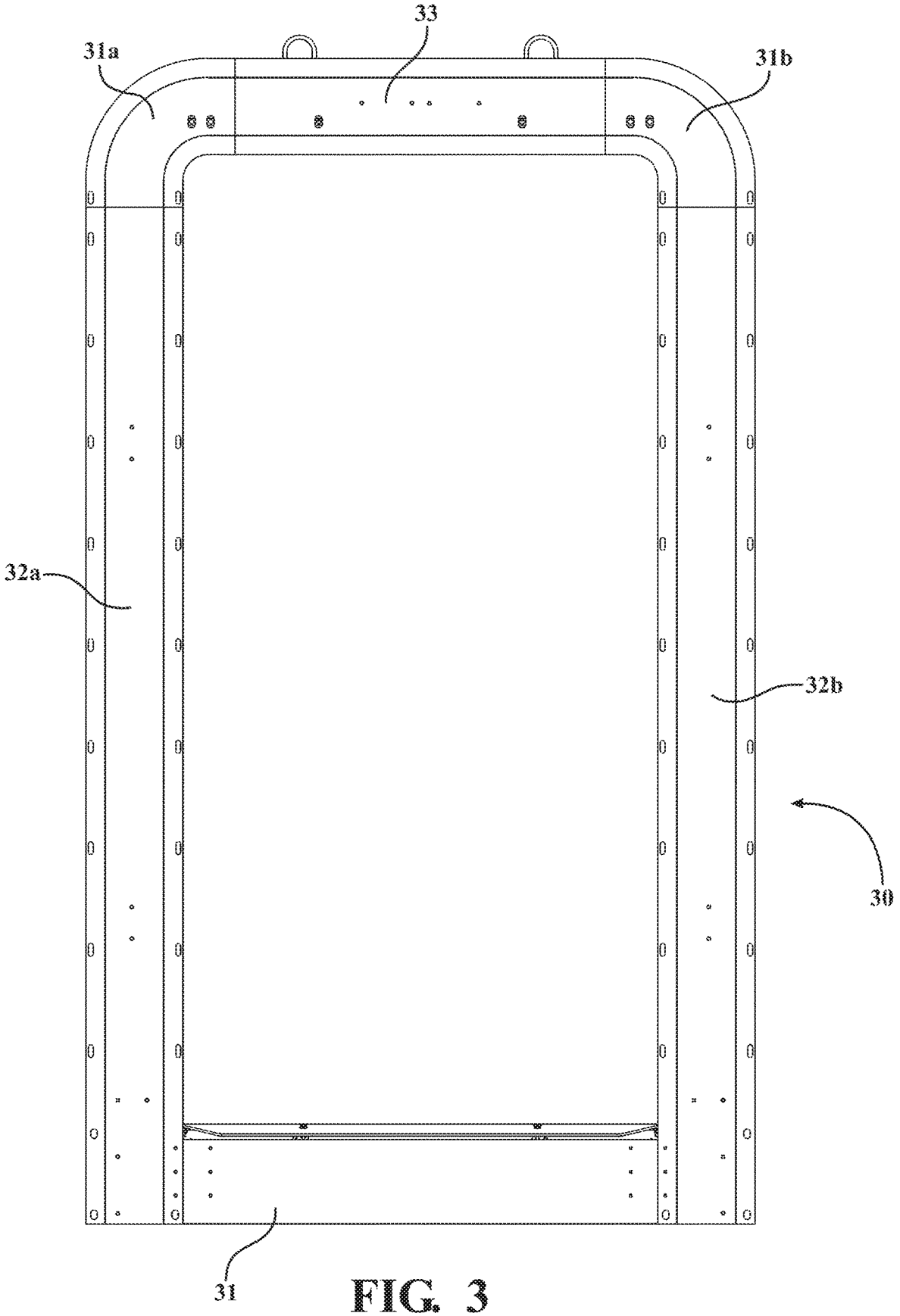
FIG. 3 is a front view of a car side assembly of the diaphragm in FIG. 1.

FIG. 3 shows an embodiment of the car mounting side 34 of the car side assembly 30, which includes two upper corner pieces 31*a*, 31*b* and a number of straight pieces, including a top horizontal piece 33, a bottom horizontal piece 31 and two side vertical pieces 32*a*, 32*b*. The straight pieces may be made of extrusions. The corner curved pieces may be made by casting or machined metal. In other embodiments, the car mounting side 34 can include fewer or more segments than shown in FIG. 3.

The car side assembly 30 can include one or multiple lifting rings, such as the lifting rings 39*a* and 39*b*, that can be used to lift and attach the diaphragm 10 to the end wall of a railcar or to remove the diaphragm 10 from the end wall of the railcar for replacement or repair. The lifting rings 39*a*, 39*b* can also be used for lifting the car side assembly.

The car side assembly may further include rubber limiting stoppers 38 in multiple locations, such as on the inside of the two side vertical pieces 32*a*, 32*b* of the car side assembly 30. The rubber stoppers can also be located on the inside of the vertical side straight segments 23*a*, 23*b*, 25*a*, 25*b* of the wear side assembly or other suitable locations.

The car side and wear side assemblies can be made of aluminum extrusions, castings, aluminum sheets, steel, fiberglass, or composite materials. The car side and wear side assemblies can be welded, adhered, bonded, or fastened together.

Referring to FIG. 1, the bellows assembly 40 provides passengers a means to transition from one rail car to the next while mitigating potential opening. Diaphragms also provide limited protection from the environment, and noise when the passengers move between railcars. The bellows assembly 40 is made of a flexible water resistant material. For example, the bellows assembly 40 can be made of silicone, pvc, hypalon/csm, rubber compound, or polyester mesh in any thickness variance. Bellows material can be single or multi layered.

The bellows assembly 40 includes an outer surface that is in contact with the outside environment and an inner surface that defines at least a portion of the passageway or path through which passengers walk when passing from one railcar to another.

In some embodiments, the bellows assembly 40 may include an inner bellows assembly 44 and an outer bellows assembly 42. Both the inner and outer bellows assemblies may be made of the bellows materials which are sewn together into U-shaped corrugations.

As shown in FIG. 1, the outer bellow assembly shows a corrugated configuration having two U-shapes sewn together. The inner bellow assembly shows a corrugated configuration having four U-shapes sewn or sealed together. The U-shaped inner bellows may be inverted relative to the U-shaped outer bellows. There may be other numbers of corrugations in the outer and inner bellows. The inner bellows and the outer bellows may have the same or different numbers of the corrugations.

The bellows assembly 40 may also include a bottom cover or flap (not shown) that protects passengers from dirt, water, and/or debris that can originate from below the diaphragm 10 when the train is moving.

The diaphragm further includes an elastomer suspension unit assembly 50. As embodied in FIGS. 5, 6 and 7-10, the elastomer suspension unit assembly 50 may include an elastomer suspension unit 70 coupled to an arm 54, 54'. The arm 54, 54' may rotate at the elastomer suspension unit and allow for compression, pivoting and angle compensation of the elastomer suspension unit assembly relative to the wear side assembly. Under a torque, the elastomer suspension unit 70 is configured to urge or bias the arm towards a neutral position against the torque.

The rubber suspension units can be of a square or rectangular shape, with or without additional fastener flanges. The suspension units may be extruded or cast, with an outer frame, a center metal housing and one or more pieces of rubber inserts. The frame may have round inner and outer corners. The inner metal element may be square, rectangular, round or other shapes. The elastomer inserts may fill the partial or entire empty space. There will be empty space remaining between the elastomer inserts if the elastomer insert does not fill the entire empty space. The elastomer suspension units may be made of aluminum or steel. The elastomer inserts of the elastomer suspension units may be of natural rubber, synthetic rubber, other elastomer materials, or a mix thereof.

A mounting bracket which complements the outer shape of the elastomer suspension unit frame may be used to mount an elastomer suspension unit to the car side assembly. The elastomer suspension frame can also include mounting provisions such as flanges so that the elastomer suspension unit can be mounted to the car side assembly directly without using a mounting bracket. The elastomer suspension unit can alternatively be mounted to the wear side assembly. However, it is preferred that the elastomer suspension unit be mounted to the car side assembly.

In this embodiment, the elastomer suspension unit assembly includes two symmetric halves 50 mirroring each other, each half including an elastomer suspension unit and an arm coupled thereto. An elastomer suspension unit having two central metal housings connected to each other may also be used such that each metal housing can be coupled to an arm and thus, only one elastomer suspension unit is necessary in this case.

Figure 7:
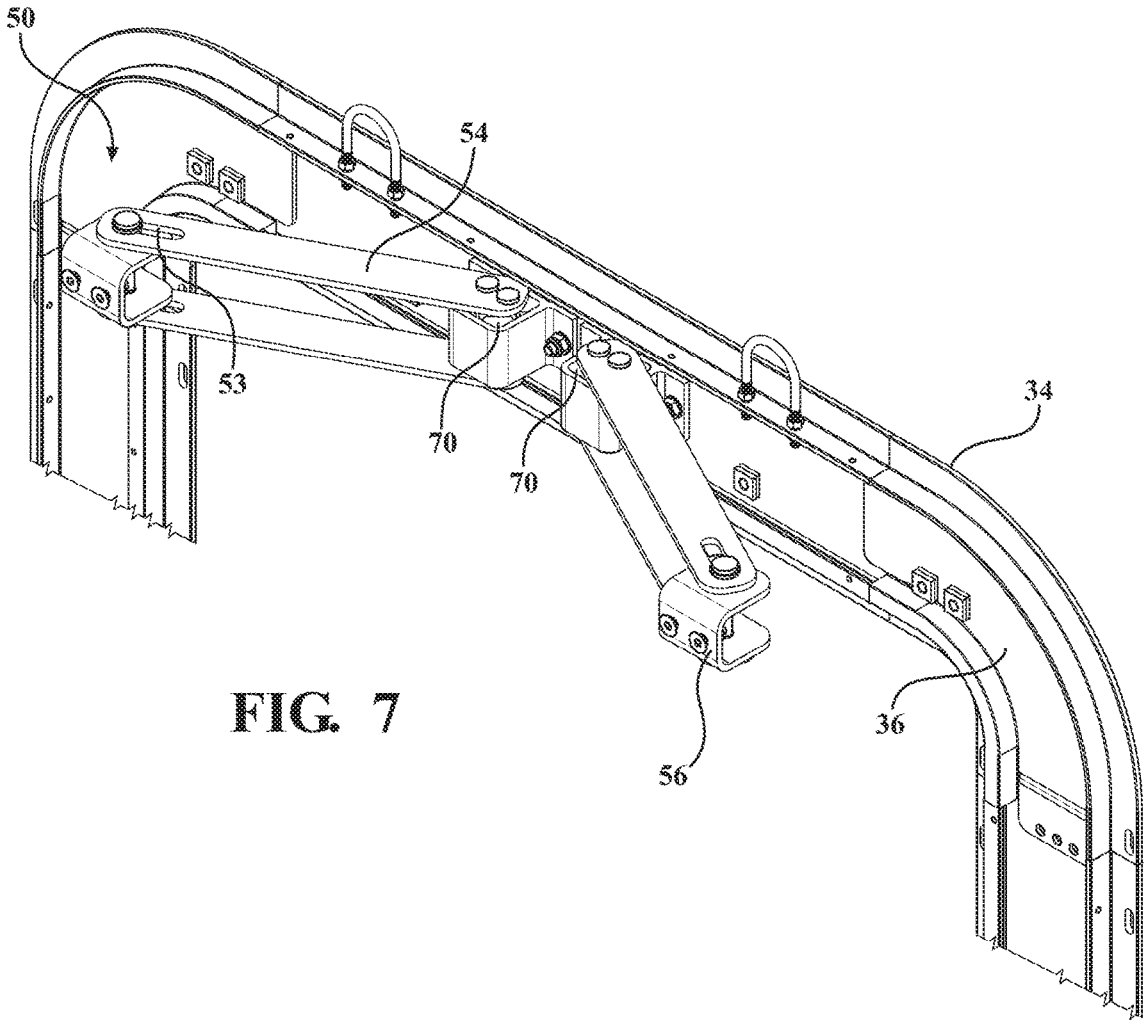
FIG. 7 is a partial perspective view of the diaphragm of FIG. 1.

The arm 50 may include only an upper part and a bottom part aligned in parallel, both parts of the arm coupled to the same elastomer suspension unit on one end and to the same bearing assembly on the other end, as shown in FIG. 7. In the version shown in FIGS. 9 and 10, the arm only includes one part.

The elastomer suspension unit assembly 50 may further include a bracket 55 and a bearing assembly 56.

The elastomer suspension unit 70 is secured to the inner elastomer suspension mounting side 36 of the car side assembly 30 by the bracket 55. The bracket can be screwed onto the inner elastomer suspension mounting side 36 of the car side assembly 30. The elastomer suspension unit 70 may also include mounting flanges such that the bracket is not necessary for mounting the elastomer suspension unit 70 to the car side assembly or the wear side assembly. The arm 54 is pivotally coupled to the elastomer suspension unit 70 at one end 57 and pivotally connected to the bearing assembly 56 at the other end 58. The arm 54 is coupled to the wear side assembly 20 by mounting the bearing assembly 56 to the inner mounting side 29 of the wear side assembly 20.

The bearing assembly may be comprised of a pin, bushings, a mounting plate and fasteners. The arm may be a sliding arm configured to slide relative to the bearing assembly. In some embodiments, the arm includes a slot 53 along which the arm slides as the arm pivots about the elastomer suspension unit. The bearing assemblies are located such that the arms are at an angle relative to the car side assembly and wear side assembly when the diaphragm is in the nominal state. The nominal state of the diaphragm will be described later. In some embodiments, the slot in located on the bearing assembly. In other embodiments, there are no slots and the arm pivots about but does not slides relative to the bearing assembly.

Figure 8:
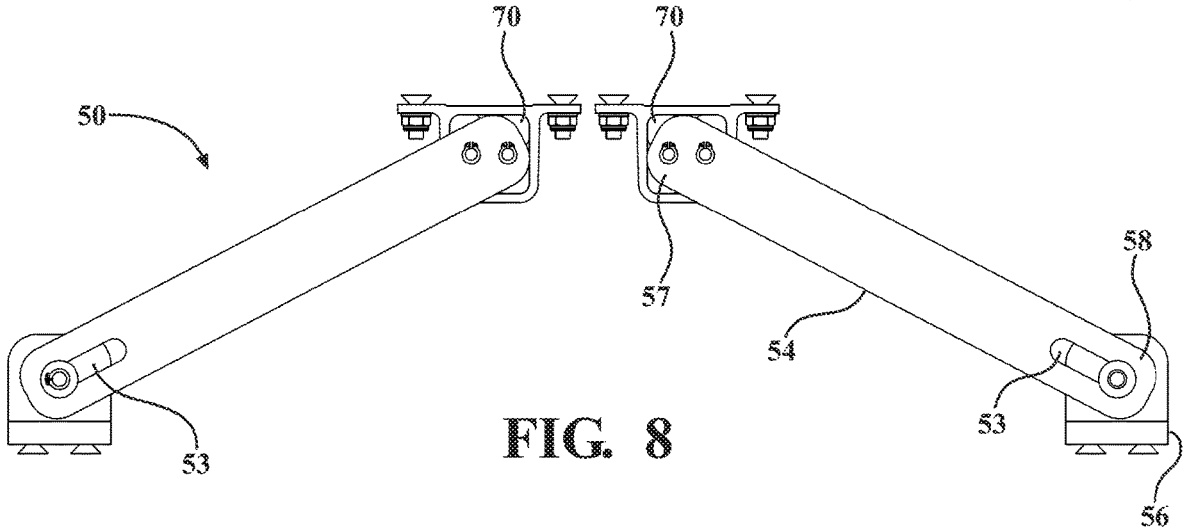
FIG. 8 is a partial end view of the diaphragm of FIG. 1.
Figure 9:
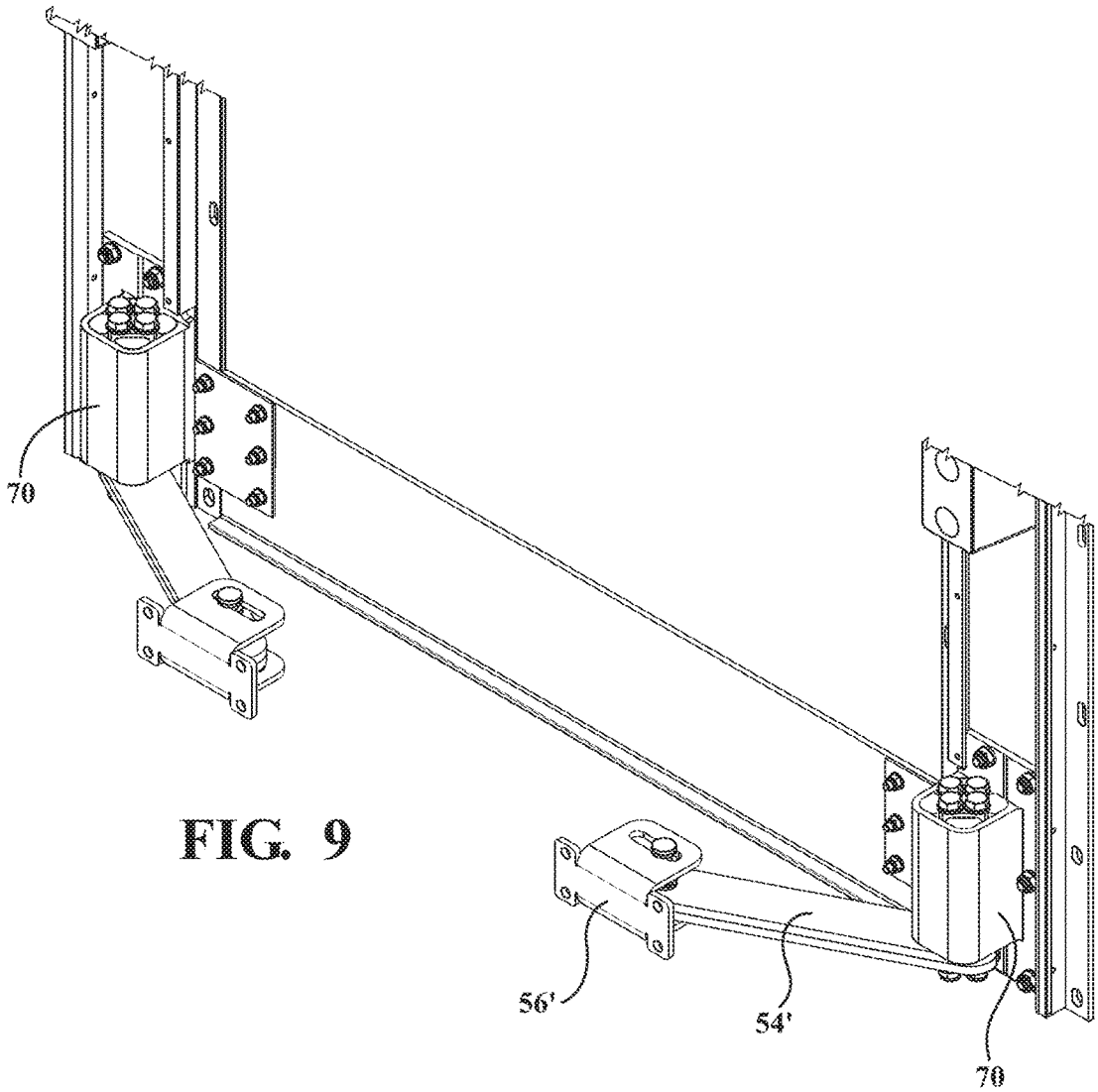
FIG. 9 is a partial perspective view of the diaphragm of FIG. 1.
Figure 10:
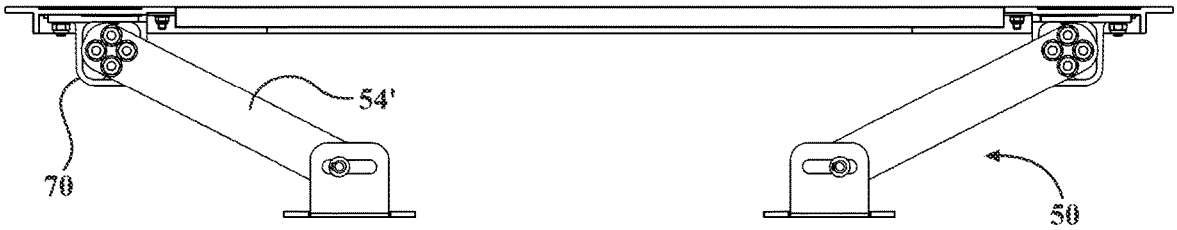
FIG. 10 is top view of an elastomer suspension unit assembly in accordance with an embodiment of the present invention.

In the embodiment shown in FIGS. 2, 7 and 8, the elastomer suspension unit 70 is mounted in the central region of the top horizontal segment of the elastomer suspension mounting side 36 of the car side assembly 30. The elastomer suspension unit 70 may also be mounted at the outer regions of the top horizontal segment of the diaphragm. The elastomer suspension unit 70 may also be mounted at the bottom or sides of the diaphragm, as shown in FIGS. 9 and 10. The elastomer suspension unit 70 may be located in multiple locations at one time on the diaphragm. The elastomer suspension unit may be single, parallel, or in series for the top or bottom setup.

Still referring to FIGS. 2 and 7, in this embodiment, two elastomer suspension units 70 are mounted to the upper horizontal segment of the inner elastomer suspension mounting side 36 in the middle region of the upper horizontal segment. Each of the elastomer suspension units 70 is pivotally connected to an arm 54, the other end of which is connected to a bearing assembly 56. The two bearing assemblies are located and attached to the outer portions of the upper horizontal segment of the inner mounting side 29 of the wear side assembly 20, one on each side of the elastomer suspension units 70. When the railcars are moving relative to each other, the arms 54 will pivot about the elastomer suspension unit 70 and the bearing assembly 56. Depending on the driving conditions and the track conditions, for example, when there is curve on the track or when the railcars are slowing down or speeding up, the diaphragm can be in a nominal/coupled state, a fully compressed state or an angled state according to the track geometry.

When the railcar is not coupled to another railcar, the diaphragm and the elastomer suspension unit assembly is in an original or a neutral state or an initial state. There may be no load or torque acting on the elastomer suspension unit at the original state, i.e., the elastomer suspension unit is at a non-biased state. The bellows is in an extended state when the diaphragm is not coupled to train cars. When the diaphragm is coupled to train cars, the diaphragm can be in a nominal state or a compressed state. In the case where the length of the bellows is such that an initial load is preloaded on the elastomer suspension unit assembly, the nominal state is not the same as the initial state. When the adjacent railcars move relative to each other, the bellows assembly may be further compressed. At the same time, the arm of the elastomer suspension unit assembly pivots about the elastomer suspension unit, putting a torque on the metal element resulting a bias caused by the elastomer inserts. At this time, the elastomer suspension unit assembly is said to be biased towards the initial state. When the railcars make turns on a curved track, the wear side assembly of two engaging railcars may be separated at the outer portion of the curve.

FIGS. 9 and 10 show an embodiment of using elastomer suspension units at the bottom of the diaphragm. Each elastomer suspension unit 70 is mounted to the inner side of the lower portion of the vertical side segments 32*a*, 32*b* of the car side assembly. An arm 54' is pivotally coupled to each elastomer suspension unit 70 on one end and attached to a bearing assembly 56' on the other end. The bearing assemblies 56' are mounted to the inner mounting side 29 of the bottom horizontal straight segment 26 of the wear side assembly 20. In some embodiment, the arm can also slide relative to the bearing assembly, along a slot on the bearing assembly, as shown in FIG. 5. The bearing assemblies are located such that the arms are at an angle relative to the car side assembly and wear side assembly when the bellows is in the nominal state. The arm 54' rotates at the elastomer suspension unit and allows for compression, pivoting and angle compensation at the bearing assembly.

In other embodiments, the elastomer suspension unit assembly 50, as shown in FIG. 7, can be used at the bottom of the diaphragm too. Likewise, the elastomer suspension unit assembly, as shown in FIGS. 9 and 10, can be used at the top of the diaphragm too.

In some embodiments, an elastomer suspension unit assembly 50, as shown in FIG. 7, or an elastomer suspension unit assembly, as shown in FIGS. 9 and 10, can be used at the top of a diaphragm, while a rubber mount can be used at the bottom of the diaphragm.

Figure 11:
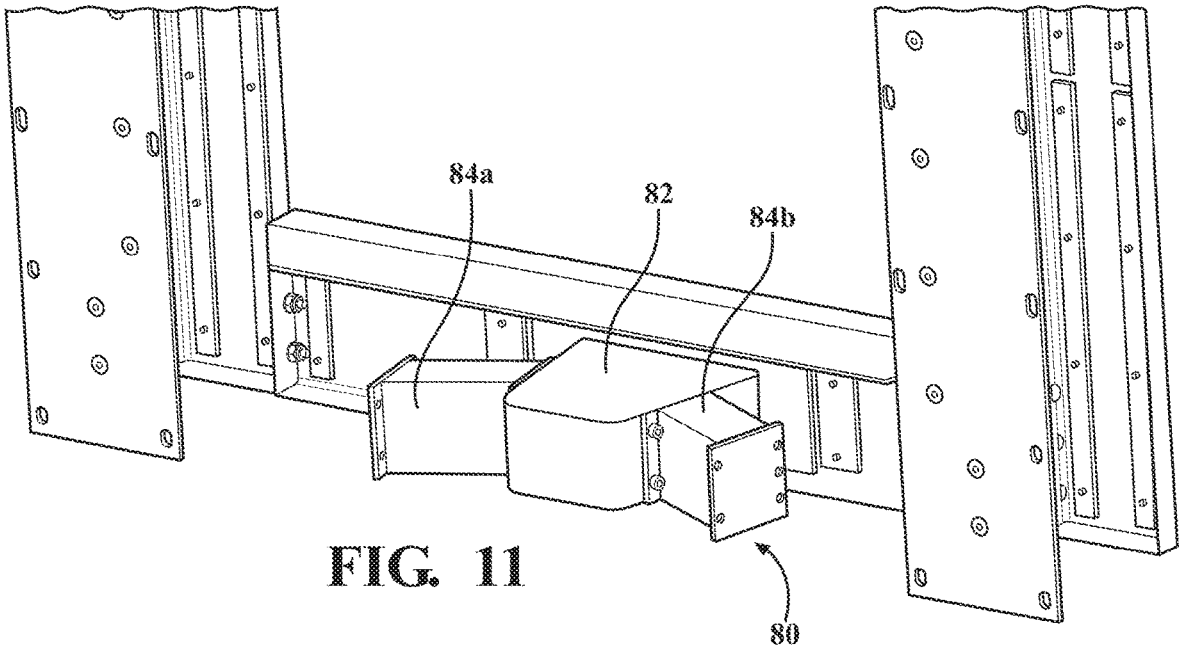
FIG. 11 is a perspective view of a rubber mount assembly in accordance with an embodiment of the present invention.

FIG. 11 shows an embodiment of a rubber support assembly 80. The rubber support assembly 80 includes a rubber mount 82 and two rubber support 84*a*, 84*b*. The rubber support 84*a*, 84*b* are coupled to support structures of the railcar when two adjacent railcars are coupled.

Figure 12:
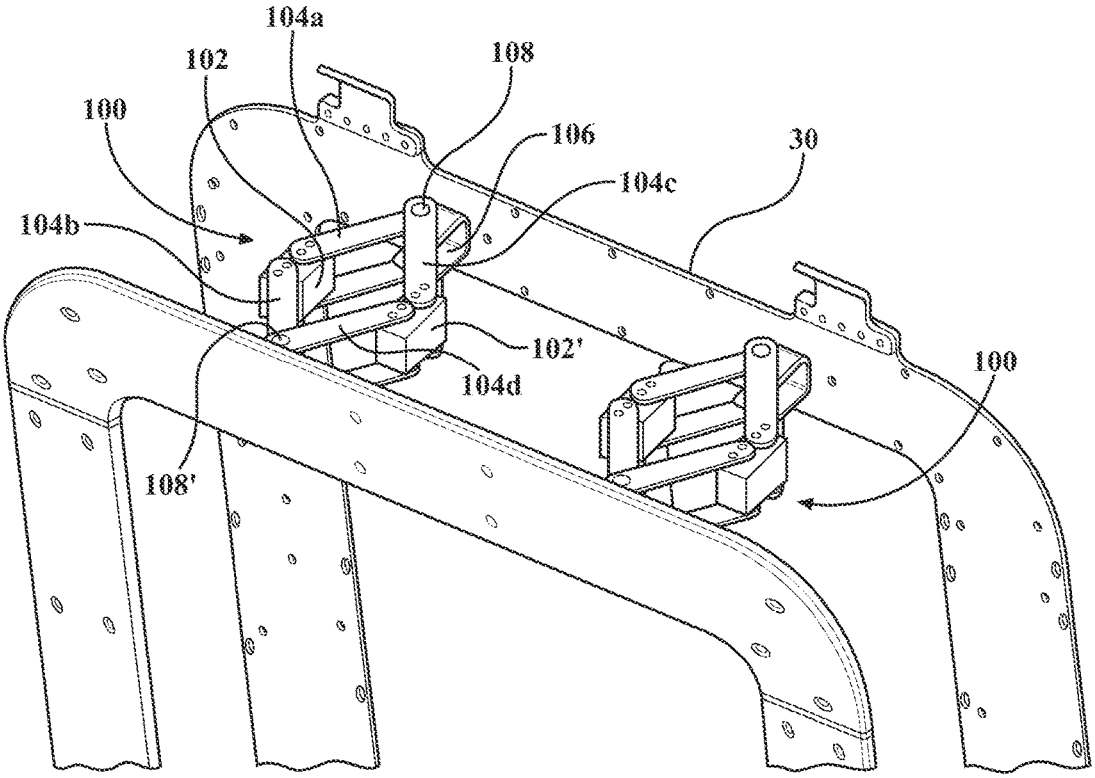
FIG. 12 is a partial perspective view of a railroad car diaphragm in accordance with another embodiment of the present invention.

FIG. 12 shows another embodiment of a diaphragm, with the bellows removed, having another embodiment of an elastomer suspension unit assembly 100. In this embodiment, the elastomer suspension unit assembly 100 may include two arms 104 connected by an elastomer suspension unit 102. The other end of each arm is coupled to the car side assembly 30 and the wear side assembly 20 via a bearing assembly 106.

In another embodiment, the elastomer suspension unit assembly 100 may be coupled to the car side assembly via a bearing assembly 106 and to the wear side assembly via a second elastomer suspension unit (not shown). In another embodiment, the elastomer suspension unit assembly 100 may be coupled to the car side assembly via a second elastomer suspension unit (not shown) and to the wear side assembly via a bearing assembly 106.

In another embodiment, the elastomer suspension unit assembly 100 may comprise four arms 104*a*, 104*b*, 104*c*, 104*d* to form a scissor jack configuration. Each arm 104*a*, 104*b*, 104*c*, 104*d* may include an upper part and a lower part, aligned in parallel to each other. A first arm 104*a* and a second arm 104*b* are jointed by a first elastomer suspension unit 102. A third arm 104*c* and a fourth arm 104*d* are jointed by a second elastomer suspension unit 102'. The other end first arm and the third arm are jointed by a first bearing assembly 108. The other end of the second arm and the fourth arm are jointed by a second bearing assembly

108'. The elastomer suspension unit assembly is coupled to the car side assembly and wear side assembly via the first and the second bearing assemblies. The elastomer suspension unit may be a dual-housing elastomer suspension unit 102, 102' for connecting to one arm 104*a*, 104*b*, 104*c*, 104*d* at each housing. In another version, one of the first and second bearing assemblies 108, 108' may be an elastomer suspension unit while the other is a bearing assembly.

There can be single or multiple elastomer suspension unit assemblies 100 at the top, bottom or sides of the diaphragm. Multiple elastomer suspension unit assemblies 100 together can also be considered as one elastomer suspension unit assembly. The elastomer suspension unit assembly 100 can be mixed with any other embodiment of the elastomer suspension unit assembly disclosed herein, the rubber support mount and/or rubber stoppers. At the bottom of the diaphragm, it can be the rubber support mount 80, the elastomer suspension unit assembly 100, or the elastomer suspension unit assembly 50, or other.

Figure 13:
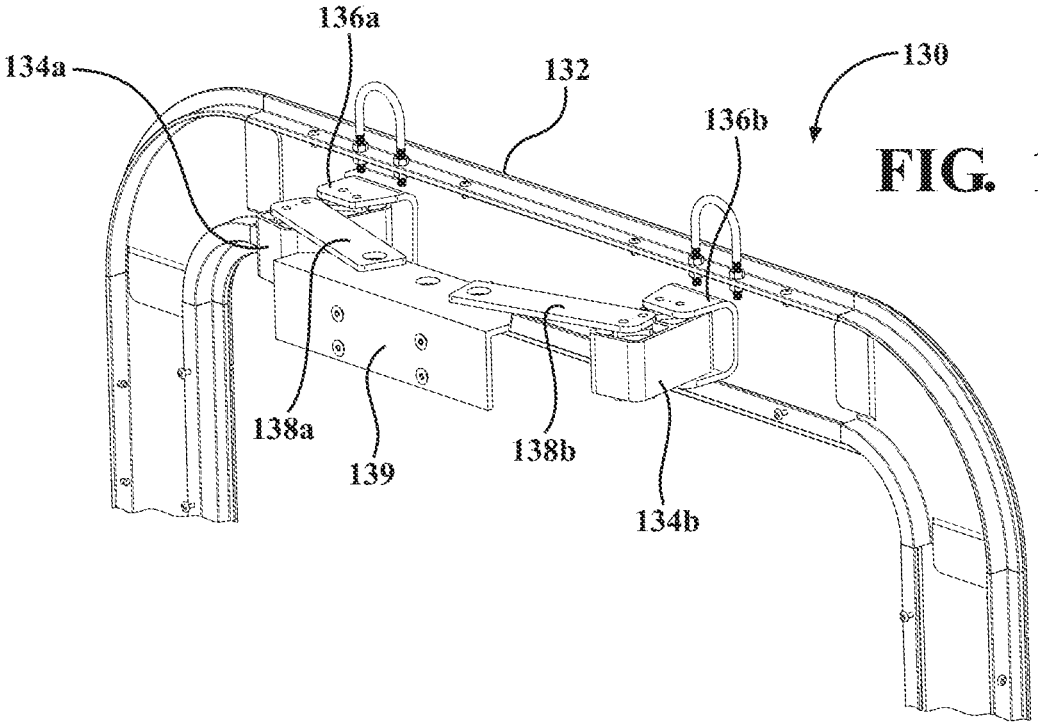
FIG. 13 is a partial perspective view of an elastomer suspension unit assembly mounted to the top of the wear side of a railroad car diaphragm in accordance with another embodiment of the present invention.

FIG. 13 shows another embodiment of an elastomer suspension unit assembly 130 having two arms 138*a*, 138*b* each coupled to one bearing assembly 139 at one end. The elastomer suspension unit 130 may further comprise one elastomer suspension unit 134*a*, 134*b* each coupled to the other end of the arms 138*a*, 138*b*. The bearing assembly 139 may be mounted to the wear side 132 or car side (not shown) of a diaphragm. The elastomer suspension unit 134*a*, 134*b* may be mounted to the other of the wear side or car side of a diaphragm. The elastomer suspension unit 134*a*, 134*b* may be a single housing or dual housing elastomer suspension unit. As shown in FIG. 13, dual-housing elastomer suspension units are used and mounted to the wear side via mounting brackets 136*a*, 136*b*. In another version, mounting brackets may be omitted if the elastomer suspension units with mounting flanges are used. The two elastomer suspension units mounted to the car side or wear side assembly such that the first arm and the second arm mirror each other.

Figure 14:
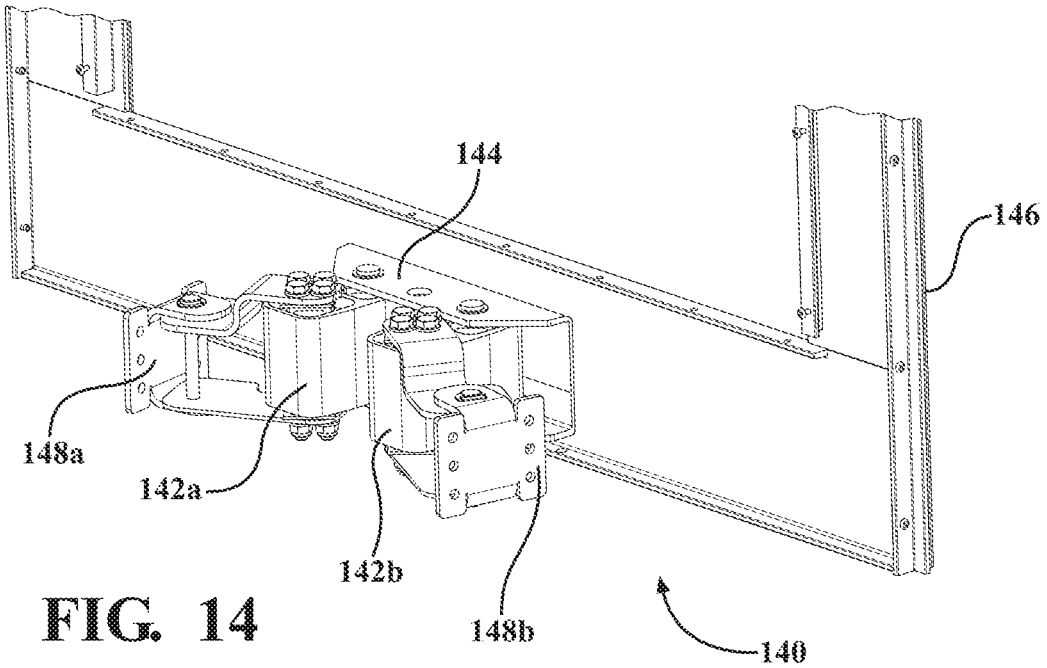
FIG. 14 is a partial perspective view of an elastomer suspension unit assembly mounted to the bottom of the wear side of a railroad car diaphragm in accordance with another embodiment of the present invention.
Figure 15:
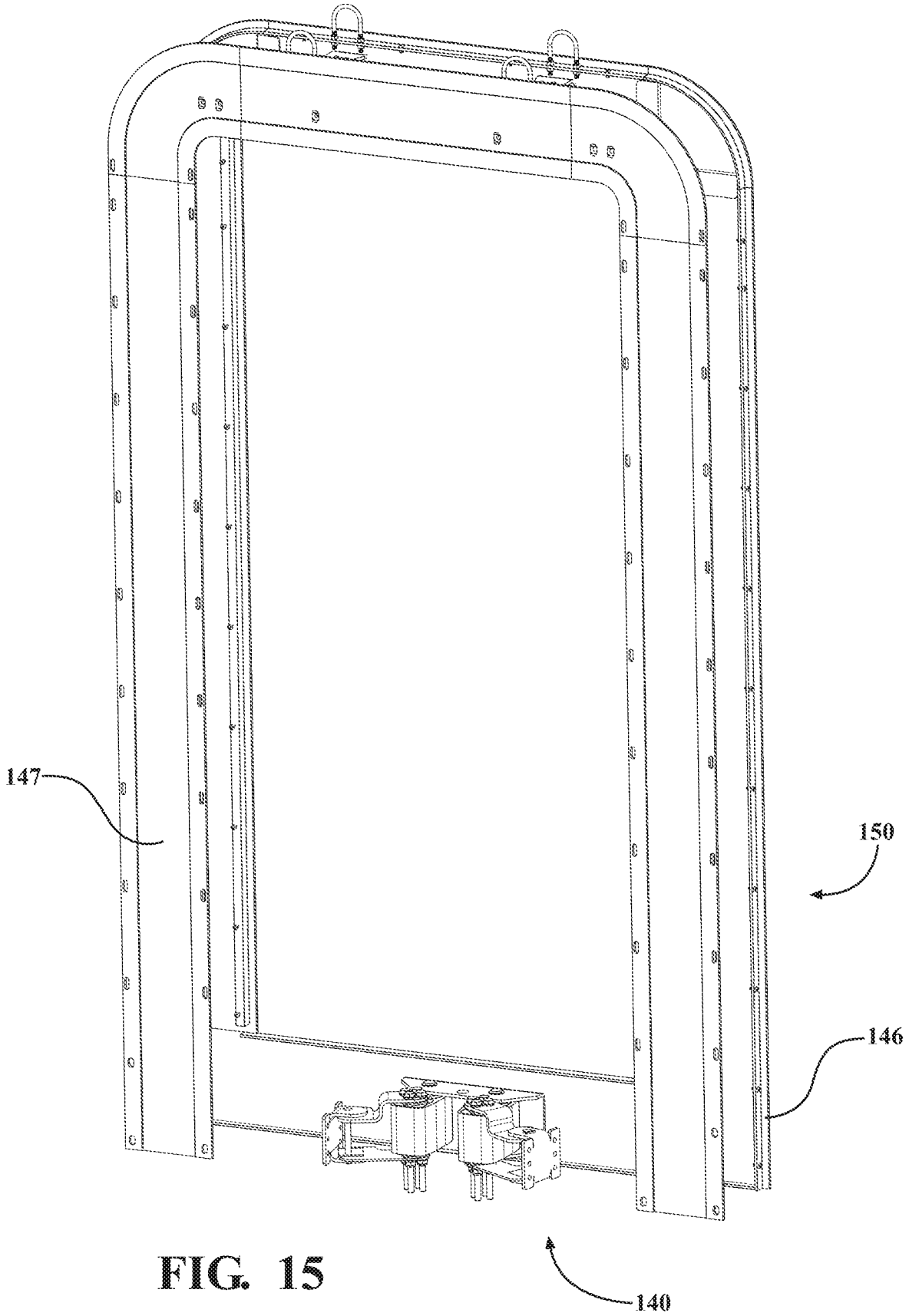
FIG. 15 is a perspective view of a railroad car diaphragm with an elastomer suspension unit assembly of FIG. 14.

In another embodiment shown in FIGS. 14 and 15, an elastomer suspension unit assembly 140 is used as train mounts to connect onto a train railcar body, as opposed to using rubber shear mounts to connect to the train body, as shown in FIG. 11. The elastomer suspension unit assembly 140 may be mounted at the bottom of the wear side 146 of a diaphragm 150. The bottom part of the car side 147 of the diaphragm 150 is open to allow for the train mounts 140 to pass through. The elastomer suspension unit assembly 140 may include two bearing assemblies 148*a*, 148*b*. The bearing assemblies 148*a*, 148*b* may each be coupled to an elastomer suspension unit 142*a*, 142*b*. The elastomer suspension units 142*a*, 142*b*, shown in FIG. 14 are dual-housing elastomer suspension units which are mounted to the wear side 146 via a mounting bracket 144. In another version, two single-housing elastomer suspension units may be used if the single-housing elastomer suspension unit includes a mounting flange. In yet another version, one dual-housing elastomer suspension unit may be used, with each housing coupled with one of the bearing assemblies 148*a*, 148*b*.

Figure 16:
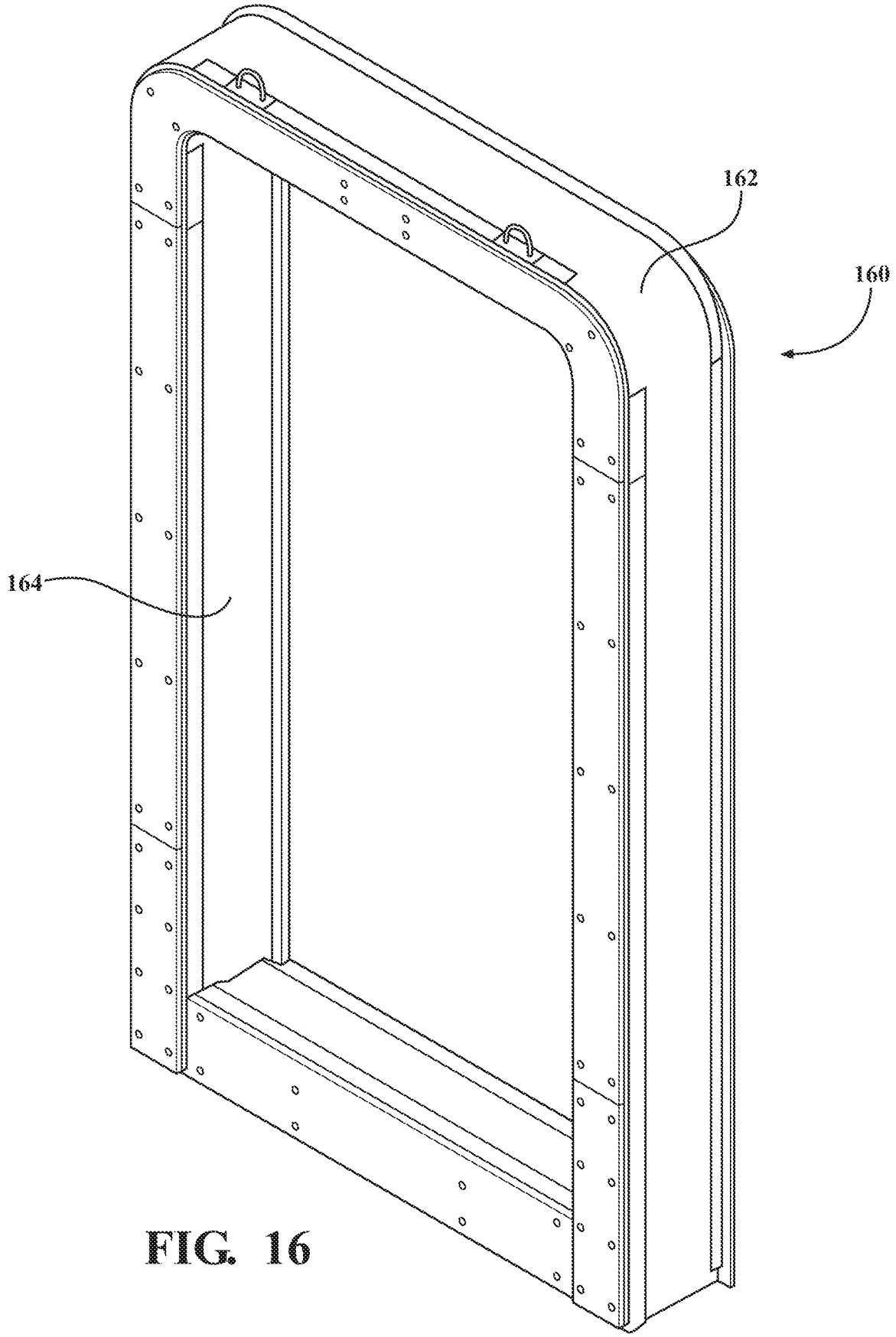
FIG. 16 is a perspective view of a diaphragm with flat fabric in accordance with an embodiment of the present invention.

FIG. 16 shows another embodiment of the diaphragm 160. Instead of having U-shaped bellows, the diaphragm 160 can include flat fabric 162, 164 on the outer and inner side of the bellows assembly.

As will be clear to those of skill in the art, the embodiments of the present invention illustrated and discussed herein may be altered in various ways without departing from the scope or teaching of the present invention. Also, elements and aspects of one embodiment may be combined with elements and aspects of another embodiment. It is the following claims, including all equivalents, which define the scope of the invention.

LIST OF REFERENCE NUMBERS

10 Diaphragm
20 Wear side assembly
21*a*, 21*b* Lifting rings
22 Walk plate
23*a*, 23*b* Upper vertical side straight segments of the wear side assembly
24 Top horizontal segment of the wear side assembly
25*a*, 25*b* Vertical side straight segments of the wear side assembly
26 Lower horizontal segment wear side assembly
28 Wear plate side
29 Inner mounting side
30 Car side assembly
31 Bottom horizontal piece of the car side assembly
31*a*, 31*b* Upper corner pieces of the car side assembly
32*a*, 32*b* Side vertical pieces of the car side assembly
33 Top horizontal piece of the car side assembly
34 Car mounting side
36 Suspension unit mounting side
38 Rubber stopper
39*a*, 39*b* Lifting rings
40 Bellows assembly
42 Outer bellows assembly
44 Inner bellows assembly
50 Elastomer suspension unit assembly
53 Slot
54 Arm
54' Arm
55 Bracket
56 Bearing assembly
56' Bearing assembly
57 One end of the arm
58 Other end of the arm
70 Elastomer suspension unit
80 Rubber support assembly
82 Rubber mount
84*a*, 84*b* Rubber supports
100 Elastomer suspension unit assembly
102 Dual-housing elastomer suspension unit
104 Arm
106 Bracket assembly
130 Elastomer suspension unit assembly
132 Wear side assembly
134*a*, 134*b* Elastomer suspension units
136*a*, 136*b* Mounting brackets
138*a*, 138*b* Arms
139 Bearing assembly
140 Elastomer suspension unit assembly
142*a*, 142*b* Elastomer suspension units
144 Mounting bracket
146 Wear side assembly
147 Car side assembly
148*a*, 148*b* Bearing assemblies
150 Diaphragm
160 Diaphragm
162 Fabric on the outer side of the bellows
164 Fabric on the inner side of the bellows

The invention claimed is:

1. A railcar diaphragm, comprising:

a car side assembly configured to be coupled to an end wall of a railcar;

a wear side assembly configured to engage the wear side assembly of another railcar diaphragm or an other railcar when the other railcar is coupled to the railcar;

a bellows assembly disposed between the car side assembly and the wear side assembly to provide a pathway; and at least one elastomer suspension unit assembly including:

an elastomer suspension unit;

a bearing assembly; and an arm having a first end coupled to the elastomer suspension unit and a second end coupled to the bearing assembly;

wherein the at least one elastomer suspension unit assembly is coupled to one of the car side and wear side assembly via the bearing assembly; and wherein the diaphragm has an initial position when the bellows assembly is in an extended state and the at least one elastomer suspension unit assembly is unbiased, the diaphragm further having a nominal state and a compressed state in which the at least one arm is biased by the elastomer suspension unit towards the initial position as a distance between the car side assembly and the wear side assembly changes;

wherein the at least one elastomer suspension unit assembly includes four elastomer suspension unit assemblies, two of the four elastomer suspension unit assemblies being mounted to the top or bottom of the car side assembly and the wear side assembly such that the two of the four elastomer suspension unit assemblies mirror each other, and the other two of the four elastomer suspension unit assemblies being mounted to the bottom or top of the car side assembly and the wear side assembly such that the two of the four elastomer suspension unit assemblies mirror each other;

wherein the elastomer suspension units of two of the four elastomer suspension unit assemblies at the top or bottom are mounted to a central region of the top or bottom of the car side assembly and the wear side assembly and the elastomer suspension units of the other two of the four elastomer suspension unit assemblies at the bottom or top are mounted to the sides of the top or bottom of the car side assembly and the wear side assembly.

2. The railcar diaphragm of claim 1, wherein each elastomer suspension unit and the respective bearing assembly are mounted such that the respective arm is at an angle relative to the car side assembly and the wear side assembly, when the bellows assembly is in the nominal state.

3. The railcar diaphragm of claim 1, wherein each arm of the four elastomer suspension assemblies slides and pivots relative to the respective bearing assembly when the distance between the car side assembly and the wear side assembly changes.

4. The railcar diaphragm of claim 1, further comprising a rubber support assembly, wherein the rubber support assembly is mounted at the bottom of the railcar diaphragm.

5. The railcar diaphragm of claim 1, further comprising a plurality of rubber stoppers mounted on the sides of the car side assembly or the wear side assembly.

6. The railcar diaphragm of claim 1, wherein the two bearing assemblies of the other two elastomer suspension unit assemblies are directly mounted to an other railcar body, wherein the bottom of the car side assembly is open to allow the two bearing assemblies of the other two elastomer suspension unit assemblies to be directly mounted to the other railcar body.

7. A railcar diaphragm, comprising:

a car side assembly configured to be coupled to an end wall of a railcar;

a wear side assembly configured to engage the wear side assembly of another railcar diaphragm or an other railcar when the other railcar is coupled to the railcar;

a bellows assembly disposed between the car side assembly and the wear side assembly to provide a pathway;

a first elastomer suspension unit assembly mounted at the top of the car side assembly and the wear side assembly, the first elastomer suspension unit assembly including:

two elastomer suspension units spaced apart and mounted to one of the car side assembly and wear side assembly;

at least one bearing assembly mounted to the other of the car side assembly and wear side assembly; and two arms, each having a first end coupled to a respective one of the elastomer suspension units and a second end coupled to the at least one bearing assembly;

wherein the first elastomer suspension unit assembly is coupled to one of the car side and wear side assembly via the two elastomer suspension units and to the other of the car side and wear side assembly via the at least one bearing assembly; and a second elastomer suspension assembly mounted at the bottom of the car side assembly and the wear side assembly, the second elastomer suspension assembly including:

two elastomer suspension units adjacent to each other and coupled to a central region of one of the car side and wear side assembly; and two bearing assemblies, wherein each of the two bearing assemblies are connected to one of the two elastomer suspension units and the second elastomer suspension assembly is coupled to the other of the car side and wear side assembly via the two bearing assemblies;

wherein the diaphragm has an initial position when the bellows assembly is in an extended state and the first elastomer suspension unit assembly is unbiased, the diaphragm further having a nominal state and a compressed state in which the two arms are biased by the two elastomer suspension units of the first elastomer suspension unit assembly towards the initial position as a distance between the car side assembly and the wear side assembly changes.

8. The railcar diaphragm of claim 7, wherein the two arms of the first elastomer suspension assembly each slide and pivot relative to the at least one bearing assembly when the distance between the car side assembly and the wear side assembly changes.

9. The railcar diaphragm of claim 7, wherein the two bearing assemblies of the second elastomer suspension unit assembly are directly mounted to an other railcar body, wherein the bottom of the car side assembly is open to allow the two bearing assemblies of the second elastomer suspension unit assembly to be directly mounted to the other railcar body.

10. The railcar diaphragm of claim 7, further comprising a rubber support assembly, wherein the rubber support assembly is mounted at the bottom of the railcar diaphragm.

11. The railcar diaphragm of claim 7, further comprising a plurality of rubber stoppers mounted on the sides of the car side assembly or the wear side assembly.

12. The railcar diaphragm of claim 7, wherein the two elastomer suspension units and the at least one bearing assembly of the first elastomer suspension unit assembly are mounted such that the two arms are at an angle relative to the car side assembly and the wear side assembly, when the bellows assembly is in the nominal state.

13. The railcar diaphragm of claim 7, wherein the two elastomer suspension units and the at least one bearing assembly of the first elastomer suspension unit assembly are mounted such that the two arms mirror each other.

* * * * *